US011489241B2

(12) United States Patent
Kim et al.

(10) Patent No.: US 11,489,241 B2
(45) Date of Patent: Nov. 1, 2022

(54) TRANSMISSION LINE HAVING IMPROVED BENDING DURABILITY

(71) Applicant: GigaLane Co., Ltd., Hwaseong-si (KR)

(72) Inventors: Sang Pil Kim, Hwaseong-si (KR); Byung Hoon Jo, Hwaseong-si (KR); Da Yeon Lee, Hwaseong-si (KR); Byung Yeol Kim, Hwaseong-si (KR); Hee seok Jung, Hwaseong-si (KR)

(73) Assignee: GIGALANE CO., LTD., Hwaseong-si (KR)

( * ) Notice: Subject to any disclaimer, the term of this patent is extended or adjusted under 35 U.S.C. 154(b) by 0 days.

(21) Appl. No.: 16/972,644

(22) PCT Filed: Jul. 18, 2019

(86) PCT No.: PCT/KR2019/008885
§ 371 (c)(1),
(2) Date: Dec. 7, 2020

(87) PCT Pub. No.: WO2020/022698
PCT Pub. Date: Jan. 30, 2020

(65) Prior Publication Data

US 2021/0242554 A1 Aug. 5, 2021

(30) Foreign Application Priority Data

Jul. 24, 2018 (KR) ..... 10-2018-0085864

(51) Int. Cl.
*H01P 3/08* (2006.01)

(52) U.S. Cl.
CPC ..... *H01P 3/08* (2013.01)

(58) Field of Classification Search
CPC ..... H01P 3/08
See application file for complete search history.

(56) References Cited

U.S. PATENT DOCUMENTS 8,049,578 B1 * 11/2011 Albers ..... H01P 1/2135 333/134
10,257,921 B1 * 4/2019 Roy ..... H01P 3/082
(Continued)

FOREIGN PATENT DOCUMENTS

JP 2010278132 A 12/2010
JP 2014086655 A 5/2014
(Continued)

OTHER PUBLICATIONS

International Search Report from International Application No. PCT/KR2019/008885, dated Oct. 29, 2019.

*Primary Examiner* — Samuel S Outten
(74) *Attorney, Agent, or Firm* — Brundidge & Stanger, P.C.

(57) ABSTRACT

The present invention relates to a transmission line having improved bending durability, which includes a strip structure or a micro-strip structure that is divided into a base part and a bending part that is bent and unfolded based on the base part, wherein the base part and the bending part include a signal line configured to extend in a length direction so as to transmit a high frequency signal, a first dielectric of which an upper surface or a lower surface is provided with the signal line formed thereon, and a second dielectric formed above the first dielectric; and the second dielectric is coupled to the first dielectric in the base part and separated from the first dielectric in the bending part.

12 Claims, 3 Drawing Sheets

(56) References Cited

U.S. PATENT DOCUMENTS

| | | | | |
|---|---|---|---|---|
| 2009/0133906 | A1* | 5/2009 | Baek | H05K 1/0218 174/254 |
| 2014/0028413 | A1* | 1/2014 | Ishii | H01P 5/107 333/33 |
| 2015/0305142 | A1* | 10/2015 | Matsuda | H01P 3/082 29/601 |
| 2018/0206335 | A1 | 7/2018 | Kim | |

FOREIGN PATENT DOCUMENTS

| | | | | |
|---|---|---|---|---|
| KR | 1020110025640 | A | | 3/2011 |
| KR | 20170036358 | A | * | 4/2017 |
| KR | 1020170036339 | A | | 4/2017 |

* cited by examiner

[FIG. 1A]
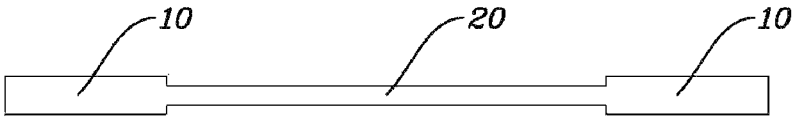
[FIG. 1B]
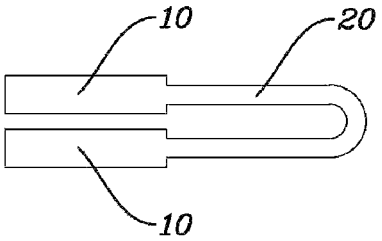
[FIG. 2A]
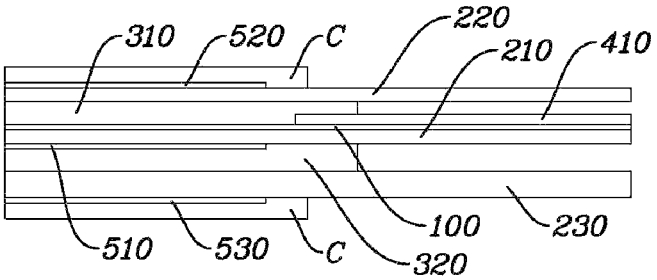
[FIG. 2B]
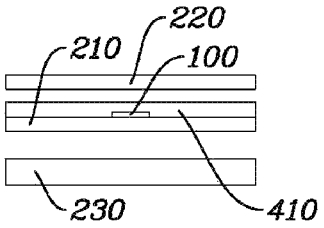

[FIG. 3]
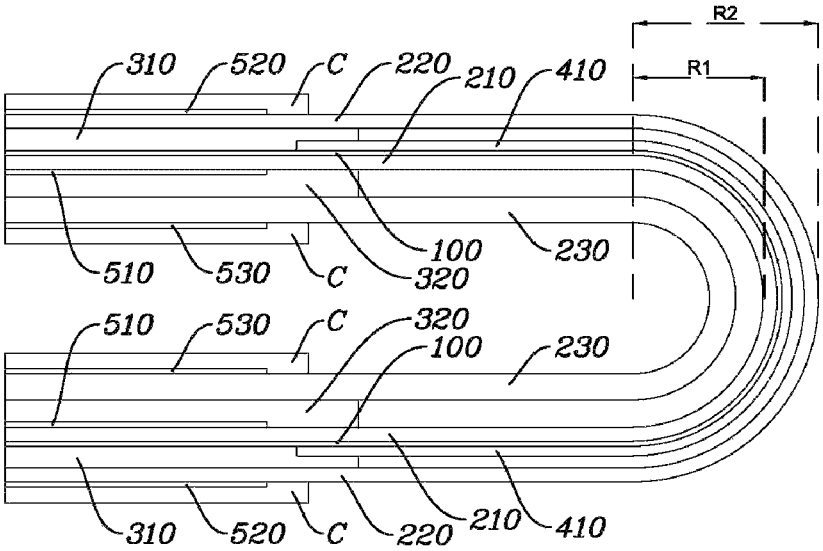
[FIG. 4A]
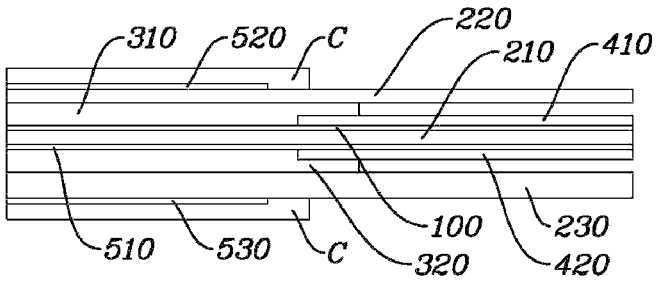
[FIG. 4B]
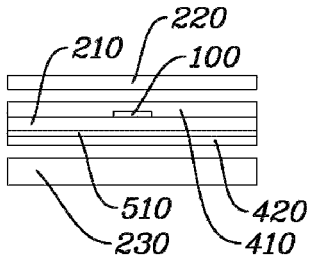

[FIG. 5A]
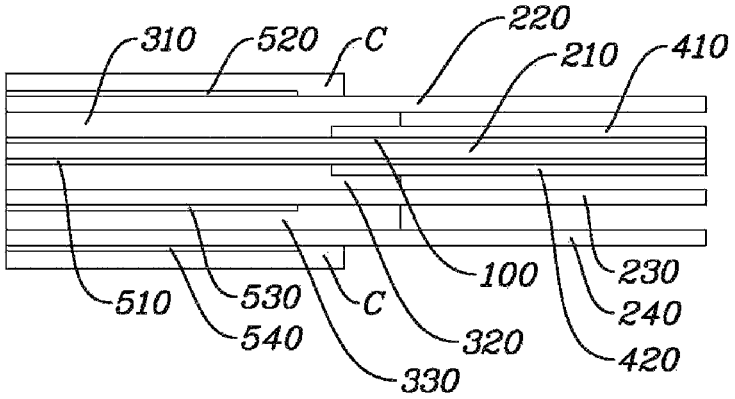
[FIG. 5B]
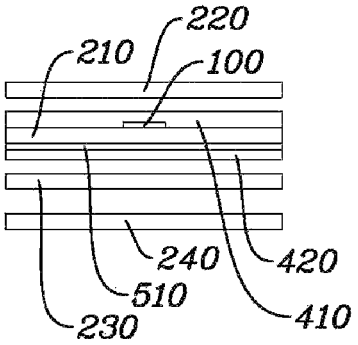

TRANSMISSION LINE HAVING IMPROVED BENDING DURABILITY

CROSS-REFERENCE TO RELATED APPLICATIONS

This Application is the National Stage filing under 35 U.S.C. § 371 of PCT Application Ser. No. PCT/KR2019/008885 filed on Jul. 18, 2019, which claims the benefit of Korean Patent Application No. 10-2018-0085864 filed on Jul. 24, 2018. The disclosures of both applications are hereby incorporated herein by reference in their entireties.

TECHNICAL FIELD

The present invention relates to a transmission line having improved bending durability.

BACKGROUND

Wireless communication terminals such as smart phones, tablets, and notebook computers include transmission lines for transmitting high-frequency signals to antennas.

Recently, a transmission line is disposed to cross a hinge in a foldable wireless communication terminal which can be folded and unfolded, and the transmission line is simultaneously bent when the wireless communication terminal is folded and unfolded.

The transmission line has a problem in that, when bent multiple times, a bending part is damaged due to stress accumulated in the bending part.

In particular, since a signal line is located in a dielectric of the bending part, there is a problem in that, when the dielectric is stressed, cracks occur in the signal line so that the high frequency transmission function of the transmission line is lost.

Technical Problem

The present invention is directed to providing a transmission line having improved bending durability.

Technical Solution

One aspect of the present invention provides a transmission line having improved bending durability, which includes a strip structure or a micro-strip structure that is divided into a base part and a bending part that is bent and unfolded based on the base part, wherein the base part and the bending part include a signal line configured to extend in a length direction so as to transmit a high frequency signal, a first dielectric of which an upper surface or a lower surface is provided with the signal line formed thereon, and a second dielectric formed above the first dielectric, and the second dielectric is coupled to the first dielectric in the base part and separated from the first dielectric in the bending part.

The transmission line may further include a first bonding sheet that is located between and couples the first dielectric and the second dielectric in the base part, and a first protective sheet having a lower side coupled to the first dielectric and an upper side separated from the second dielectric so as to separate the first dielectric from the second dielectric in the bending part.

One side of the first protective sheet may extend to the base part and may be located to overlap the first bonding sheet between the first dielectric and the second dielectric.

The base part and the bending part may further include a third dielectric formed below the first dielectric, wherein the third dielectric may be coupled to the first dielectric in the base part and separated from the first dielectric in the bending part.

The transmission line may further include a second bonding sheet that is located between and couples the first dielectric and the third dielectric in the base part, and a second protective sheet having one side coupled to the first dielectric and the other side separated from the third dielectric so as to separate the first dielectric from the third dielectric in the bending part.

The one side of the second protective sheet may extend to the base part and may be located to overlap the second bonding sheet between the first dielectric and the third dielectric.

A thickness of the third dielectric may be greater than a thickness of the second dielectric.

The base part and the bending part may further include a fourth dielectric formed below the third dielectric, wherein the fourth dielectric may be coupled to the third dielectric in the base part and separated from the third dielectric in the bending part.

The thickness of the third dielectric and a thickness of the fourth dielectric may be smaller than the thickness of the second dielectric.

The base part may further include a second ground formed in a shape corresponding to the second dielectric and formed on an upper surface of the second dielectric, and a third ground formed in a shape corresponding to the third dielectric and formed on a lower surface of the third dielectric.

The base part may further include a second ground formed in a shape corresponding to the second dielectric and formed on an upper surface of the second dielectric, a third ground formed in a shape corresponding to the third dielectric and formed on a lower surface of the third dielectric, and a fourth ground formed in a shape corresponding to the fourth dielectric and formed on a lower surface of the fourth dielectric.

The base part and the bending part may further include a first ground formed in a shape corresponding to the first dielectric and formed on a surface opposite to a surface of the first dielectric on which the signal line is formed.

Advantageous Effects

First, since a radius of curvature of a second dielectric is greater than a radius of curvature of a first dielectric in a bending part, the second dielectric is pulled to the base part instead of the first dielectric during bending, and thus the second dielectric can be stressed instead of the first dielectric which should be pulled to the base part and stressed.

Therefore, since stress is not accumulated in the first dielectric, there is an effect of being able to prevent the bending part from being damaged during multiple times of bending.

In addition, since one side of a first protective sheet is coupled to a first bonding sheet of the base part to allow the first dielectric to be gently bent, there is an effect of being able to prevent the first dielectric from being damaged.

In addition, since a third dielectric is further included, when the third dielectric is located at an outer side of the first dielectric during bending, stress of the first dielectric is applied to the third dielectric.

Therefore, since stress is not accumulated in the first dielectric, there is an effect of being able to prevent the bending part from being damaged during multiple times of bending.

In addition, when the third dielectric is located further inward than the first dielectric during bending, there is an effect in that the third dielectric can prevent the first dielectrics from being damaged due to friction with a mechanical part disposed between the facing first dielectrics or due to friction between the facing first dielectrics.

In addition, there are effects in that, during bending toward the one side, the first dielectric can be prevented from being damaged due to the first protective sheet, and further, during bending toward the other side, one side of the second protective sheet is fixed to the second bonding sheet of the base part to allow the first dielectric to be gently bent so that the first dielectric can be prevented from being damaged.

In addition, a thickness of the third dielectric located at an outer side during bending is formed to be large to increase an elastic force of the third dielectric so that there is an effect in that stress applied to the first dielectric can be further minimized.

In addition, since the third dielectric located at the outer side during bending and the fourth dielectric located at a further outer side than the third dielectric are further included, there is an effect in that the elastic force of the dielectrics can be increased to further minimize the stress applied to the first dielectric.

In addition, even when an overall thickness of the bending part is reduced, the elastic force is maintained by the third dielectric and the fourth dielectric, and thus stress is not accumulated in the first dielectric so that there is an effect of being able to prevent the bending part from being damaged during multiple times of bending.

DESCRIPTION OF DRAWINGS

FIG. 1A is an external view illustrating a bending part of a transmission line having improved bending durability that is unfolded according to the present invention.

FIG. 1B is an external view illustrating the bending part of the transmission line having improved bending durability that is folded according to the present invention.

FIG. 2A is a cross-sectional view illustrating the transmission line having improved bending durability in a transverse direction which is an extension direction of the transmission line according to Example 1 of the present invention.

FIG. 2B is a cross-sectional view illustrating the transmission line having improved bending durability in a longitudinal direction according to Example 1 of the present invention.

FIG. 3 is a cross-sectional view illustrating the bending part of the transmission line having improved bending durability that is bent in the transverse direction according to Example 1 of the present invention.

FIG. 4A is a cross-sectional view illustrating the transmission line having improved bending durability in the transverse direction, which is the extension direction of the transmission line, according to Example 2 of the present invention.

FIG. 4B is a cross-sectional view illustrating the transmission line having improved bending durability in the longitudinal direction according to Example 2 of the present invention.

FIG. 5A is a cross-sectional view illustrating the transmission line having improved bending durability in the transverse direction, which is the extension direction of the transmission line, according to Example 3 of the present invention.

FIG. 5B is a cross-sectional view illustrating the transmission line having improved bending durability in the longitudinal direction according to Example 3 of the present invention.

MODE FOR CARRYING OUT THE INVENTION

Hereinafter, embodiments of the present invention will be fully described in detail with reference to the accompanying drawings so that those skilled in the art to which the present invention pertains can easily implement the present invention.

The present invention may be implemented in various different forms, and thus it is not limited to embodiments which will be described herein.

In a transmission line having a strip structure or a microstrip structure partitioned into base parts 10 and a bending part 20 at which bending and unfolding are repeated multiple times based on the base parts 10, there is a problem in that, when the transmission line is bent several times, stress is accumulated in the bending part 20 so that the bending part 20 is damaged.

In particular, since a signal line 100 is located in a first dielectric 210 of the bending part 20, there is a problem in that, when stress is accumulated in the first dielectric 210, cracks occur in the signal line 100 so the high frequency transmission function of the transmission line is lost.

As shown in FIGS. 1 to 3, in order to solve the above problems, the base parts 10 and the bending part 20 of the transmission line having improved bending durability according to the present invention includes the signal line 100, the first dielectric 210, and a second dielectric 220.

The signal line 100 extends in a length direction to transmit a high frequency signal.

The signal line 100 is formed on an upper surface or a lower surface of the first dielectric 210.

In this case, the signal line 100 may be formed on a surface located at an outer side among the upper surface and the lower surface of the first dielectric 210, during bending.

The second dielectric 220 is formed above the first dielectric 210.

In this case, the second dielectric 220 is coupled to the first dielectric 210 in the base part 10 and separated from the first dielectric 210 in the bending part 20.

As described above, since a radius of curvature R2 of the second dielectric 220 is greater than a radius of curvature R1 of the first dielectric 210 in the bending part 20, during bending, the second dielectric 220 is pulled to the base part 10 instead of the first dielectric 210 so that the second dielectric 220 is stressed instead of the first dielectric 210 which should be stressed by being pulled to the base part 10.

Therefore, since stress is not accumulated in the first dielectric 210, there is an effect of preventing the bending part 20 from being damaged during multiple times of bending.

During bending, there is a problem in that a portion, which is located at a connection position between the base part 10 and the bending part 20, of the first dielectric 210 is sharply bent and damaged.

As shown in FIGS. 2 and 3, in order to solve the above problem, the transmission line having improved bending durability according to the present invention further includes a first bonding sheet 310 and a first protective sheet 410.

The first bonding sheet 310 is located between and couples the first dielectric 210 and the second dielectric 220 in the base part 10.

In the bending part 20, a lower side of the first protective sheet 410 is coupled to the first dielectric 210 and an upper side thereof is separated from the second dielectric 220 so that the first dielectric 210 is separated from the second dielectric 220.

In this case, one side of the first protective sheet 410 extends to the base part 10 and is located to overlap the first bonding sheet 310 between the first dielectric 210 and the second dielectric 220.

Since the first protective sheet 410 prevents a large step difference between the base part 10 and the bending part 20, the first dielectric 210 is not sharply bent but gently bent.

As described above, the one side of the first protective sheet 410 is coupled to the first bonding sheet 310 of the base part 10 to allow the first dielectric 210 to be gently bent so that there is an effect of preventing the first dielectric 210 from being damaged.

As shown in FIGS. 2 and 3, the base part 10 and the bending part 20 of the transmission line having improved bending durability according to the present invention further include a third dielectric 230.

The third dielectric 230 is formed below the first dielectric 210.

The third dielectric 230 is coupled to the first dielectric 210 in the base part 10 and separated from the first dielectric 210 in the bending part 20.

As described above, since the third dielectric 230 is further included, when the third dielectric 230 is located at an outer side of the first dielectric 210 during bending, the third dielectric 230 receives stress of the first dielectric 210.

Therefore, since stress is not accumulated in the first dielectric 210, there is an effect of preventing the bending part 20 from being damaged during multiple times of bending.

In addition, when the third dielectric 230 is located inward from the first dielectric 210 during bending, there is an effect in that the third dielectric 230 prevents the first dielectrics 210 from being damaged due to friction with a mechanical part disposed between the facing first dielectrics or due to friction between the facing first dielectrics.

As shown in FIGS. 2 and 3, the base part 10 of the transmission line having improved bending durability according to the present invention further includes a second ground 520 and a third ground 530.

The second ground 520 is formed in a shape corresponding to the second dielectric 220 and is formed on an upper surface of the second dielectric 220.

The third ground 530 is formed in a shape corresponding to the third dielectric 230 and is formed on a lower surface of the third dielectric 230.

As shown in FIG. 4, the base part 10 and the bending part 20 of the transmission line having improved bending durability according to the present invention may further include a first ground 510.

The first ground 510 is formed in a shape corresponding to the first dielectric 210 and is formed on a surface opposite to a surface of the first dielectric 210 on which the signal line 100 is formed.

During bending, there is a problem in that a portion, which is located at a connection position between the base part 10 and the bending part 20, of the first dielectric 210 is sharply bent and damaged.

As shown in FIG. 4, in order to solve the above problem, the transmission line having improved bending durability according to the present invention further includes a second bonding sheet 320 and a second protective sheet 420.

The second bonding sheet 320 is located between and couples the first dielectric 210 and the third dielectric 230 in the base part 10.

In the bending part 20, one side of the second protective sheet 420 is coupled to the first dielectric 210 and the other side thereof is separated from the third dielectric 230 so that the first dielectric 210 is separated from the third dielectric 230.

In this case, the one side of the second protective sheet 420 extends to the base part 10 and is located to overlap the second bonding sheet 320 between the first dielectric 210 and the third dielectric 230.

Since the second protective sheet 420 prevents a large step difference between the base part 10 and the bending part 20, the first dielectric 210 is not sharply bent but gently bent.

As described above, there are effects in that, during bending toward the one side, the first dielectric 210 is prevented from being damaged due to the first protective sheet 410, and also, during bending toward the other side, the one side of the second protective sheet 420 is fixed to the second bonding sheet 320 of the base part 10 to allow the first dielectric 210 to be gently bent so that the first dielectric 210 is prevented from being damaged.

As shown in FIG. 4, in the transmission line having improved bending durability according to the present invention, a thickness of the third dielectric 230 may be greater than a thickness of the second dielectric 220.

When the thickness of the third dielectric 230 is increased, an elastic force of the third dielectric 230 is increased and, even when the bending part 20 is more bent, the third dielectric 230 elastically supports the base part 10 with a high elastic force so that the first dielectric 210 is prevented from being pulled to the base part 10.

As described above, the thickness of the third dielectric 230 located at the outer side during bending is formed to be large to increase the elastic force of the third dielectric 230 so that there is an effect in that stress applied to the first dielectric 210 is further minimized.

As shown in FIG. 5, the base part 10 and the bending part 20 of the transmission line having improved bending durability according to the present invention may further include a fourth dielectric 240.

The fourth dielectric 240 is formed below the third dielectric 230.

In this case, the fourth dielectric 240 is coupled to the third dielectric 230 in the base part 10 and separated from the third dielectric 230 in the bending part 20.

In the base part 10, the fourth dielectric 240, which is coupled to the third dielectric 230, may be coupled to the third dielectric 230 through a third bonding sheet 330.

As described above, the third dielectric 230 located at the outer side during bending and the fourth dielectric 240 located at a further outer side than the third dielectric 230 are further included so that there is an effect in that the elastic force of the dielectrics is increased to further minimize the stress applied to the first dielectric 210.

The thickness of the third dielectric 230 and a thickness of the fourth dielectric 240 may be formed to be smaller than the thickness of the second dielectric 220.

That is, a plurality of thin dielectrics are disposed so that there is an effect of being able to maintain the elastic force and reduce an overall thickness of the bending part 20.

As described above, even when the overall thickness of the bending part 20 is reduced, the elastic force is maintained by the third dielectric 230 and the fourth dielectric 240, and thus stress is not accumulated in the first dielectric 210 so that there is an effect of preventing the bending part 20 from being damaged during multiple times of bending.

As shown in FIG. 5, the base part 10 of the transmission line having improved bending durability according to the present invention further includes the second ground 520, the third ground 530, and a fourth ground 540.

The second ground 520 is formed in a shape corresponding to the second dielectric 220 and is formed on the upper surface of the second dielectric 220.

The third ground 530 is formed in a shape corresponding to the third dielectric 230 and is formed on the lower surface of the third dielectric 230.

The fourth ground 540 is formed in a shape corresponding to the fourth dielectric 240 and is formed on a lower surface of the fourth dielectric 240.

For example, the bonding of the first to fourth dielectrics 210 to 240 without or with the first to third bonding sheets 310 to 330 disposed thereamong may be achieved by indirect bonding through an adhesive material applied to the surfaces thereof or by direct bonding through curing after melting of the surfaces thereof.

As described above, the present invention has been described in detail through the exemplary embodiments, but the present invention is not limited thereto and may be implemented in various forms within the scope of the appended claims.

DESCRIPTION OF REFERENCE NUMERALS

| | |
|---|---|
| 10: base part | 20: bending part |
| 100: signal line | 210: first dielectric |
| 220: second dielectric | 230: third dielectric |
| 240: fourth dielectric | 310: first bonding sheet |
| 320: second bonding sheet | 330: third bonding sheet |
| 410: first protective sheet | 420: second protective sheet |
| 510: first ground | 520: second ground |
| 530: third ground | 540: fourth ground |

What is claimed is:

1. A transmission line having improved bending durability, comprising a strip structure or a micro-strip structure that is divided into a base part and a bending part that is bent and unfolded based on the base part, wherein the base part and the bending part include:

a signal line configured to extend in a length direction so as to transmit a high frequency signal;

a first dielectric of which an upper surface or a lower surface is provided with the signal line formed thereon;

a first ground formed on a surface opposite to the upper surface or the lower surface of the first dielectric on which the signal line is formed;

a second dielectric formed above the first dielectric;

a first bonding sheet located between the first dielectric and the second dielectric in the base part; and a first protective sheet including a lower side directly coupled to the first dielectric and an upper side separated from the second dielectric in the bending part, wherein the first dielectric is coupled to the second dielectric through the first bonding sheet in the base part, and the first dielectric is separated from the second dielectric by the first protective sheet in the bending part, and wherein the first protective sheet in the base part does not overlap with the first ground of the base part in the length direction.

2. The transmission line of claim 1, wherein the base part and the bending part further include a third dielectric formed below the first dielectric, wherein the third dielectric is coupled to the first dielectric in the base part and separated from the first dielectric in the bending part.

3. The transmission line of claim 2, wherein the base part and the bending part further include a fourth dielectric formed below the third dielectric, wherein the fourth dielectric is coupled to the third dielectric in the base part and separated from the third dielectric in the bending part.

4. The transmission line of claim 3, wherein a second ground of the base part is formed in a shape corresponding to the second dielectric, and wherein the base part further includes:

a third ground formed in a shape corresponding to the third dielectric and formed on a lower surface of the third dielectric; and a fourth ground formed in a shape corresponding to the fourth dielectric and formed on a lower surface of the fourth dielectric.

5. The transmission line of claim 4, wherein the first ground formed in a shape corresponding to the first dielectric.

6. The transmission line of claim 3, wherein a thickness of each of the third dielectric and the fourth dielectric is smaller than a thickness of the second dielectric.

7. The transmission line of claim 2, further comprising:

a second bonding sheet that is located between and couples the first dielectric and the third dielectric in the base part; and a second protective sheet including one side coupled to the first dielectric and the other side separated from the third dielectric so as to separate the first dielectric from the third dielectric in the bending part.

8. The transmission line of claim 7, wherein the one side of the second protective sheet extends to the base part and is located to overlap the second bonding sheet between the first dielectric and the third dielectric.

9. The transmission line of claim 2, wherein a second ground of the base part is formed in a shape corresponding to the second dielectric, and wherein the base part further includes a third ground formed in a shape corresponding to the third dielectric and formed on a lower surface of the third dielectric.

10. The transmission line of claim 9, wherein the first ground formed in a shape corresponding to the first dielectric.

11. The transmission line of claim 2, wherein a thickness of the third dielectric is greater than a thickness of the second dielectric.

12. The transmission line of claim 1, wherein one side of the first protective sheet extends to the base part and is located to overlap the first bonding sheet between the first dielectric and the second dielectric.

* * * * *